United States Patent [19]

Gupta et al.

[11] Patent Number: 4,773,469

[45] Date of Patent: Sep. 27, 1988

[54] COMPOSITE MOLD FOR CONTINUOUS THIN STRIP CASTING

[75] Inventors: Debabrata Gupta, New Haven; Harvey P. Cheskis, North Haven, both of Conn.

[73] Assignee: Olin Corporation, New Haven, Conn.

[21] Appl. No.: 150,476

[22] Filed: Jan. 26, 1988

Related U.S. Application Data

[63] Continuation of Ser. No. 922,214, Oct. 23, 1986, abandoned, which is a continuation of Ser. No. 689,529, Jan. 7, 1985, abandoned.

[51] Int. Cl.[4] ..... B22D 11/00

[52] U.S. Cl. ..... 164/459; 164/490

[58] Field of Search ..... 164/490, 439, 440, 459

[56] References Cited

U.S. PATENT DOCUMENTS

| | | | |
|---|---|---|---|
| 2,747,244 | 5/1956 | Goss . | |
| 3,040,396 | 6/1962 | Hudson . | |
| 3,085,303 | 4/1963 | Steigerwald . | |
| 3,286,309 | 11/1966 | Brondyke et al. . | |
| 3,329,200 | 7/1967 | Craig . | |
| 3,381,741 | 5/1968 | Gardner | 164/490 |
| 3,451,465 | 6/1969 | Moritz . | |
| 3,587,718 | 6/1971 | Hopkins . | |
| 3,593,778 | 7/1971 | Foye | 164/440 |
| 3,612,149 | 10/1971 | Rossi . | |
| 3,630,266 | 12/1971 | Watts . | |
| 3,726,333 | 4/1973 | Goodrich et al. . | |
| 3,730,251 | 5/1973 | Webbere et al. . | |
| 4,074,747 | 2/1978 | Takahashi et al. . | |
| 4,103,732 | 8/1978 | Habert . | |
| 4,157,728 | 6/1979 | Mitamura et al. . | |
| 4,214,624 | 7/1980 | Foye et al. . | |

FOREIGN PATENT DOCUMENTS

| | | | |
|---|---|---|---|
| 56-84157 | 7/1981 | Japan | 164/440 |
| 56-144849 | 11/1981 | Japan | 164/440 |
| 58-90353 | 5/1983 | Japan | 164/490 |

OTHER PUBLICATIONS

"Horizontal Continuous Casting of Nickel Base Alloy" by Harvey et al., pp. 157–171.

"Transport Phenomena in Metallurgy" by Geiger et al., in the Addison-Wesley Series in Metallurgy and Materials, 1973, pp. 336–340.

*Primary Examiner*—Kuang Y. Lin

*Attorney, Agent, or Firm*—Gregory S. Rosenblatt; Paul Weinstein

[57] ABSTRACT

An apparatus and process for continuous horizontal casting of an ingot from molten metal. The apparatus comprises a mold for effecting rapid solidification of the molten metal into the ingot. A feed nozzle supplies the molten metal to the mold. Transition structure is disposed between the mold and the feed nozzle for solidifying the molten metal in the transition structure to prevent freeze back in the feed nozzle.

4 Claims, 1 Drawing Sheet

COMPOSITE MOLD FOR CONTINUOUS THIN STRIP CASTING

This application is a continuation of U.S patent application Ser. No. 922,214, filed Oct. 23, 1986 (now abandoned), which in turn is a continuation of U.S. patent application Ser. No. 689,529 (now abandoned), filed Jan. 7, 1985.

While the invention is subject to a wide range of applications, it is especially suited for continuous casting of molten metal in a thin strip casting apparatus and will be particularly described in that connection.

In conventional continuous metal casting practice, a reservoir of molten metal such as a tundish is provided. The molten metal is supplied from the reservoir into a jacketed mold which is generally water-cooled. Typically, the molten metal flows from the reservoir into the mold through a feed nozzle formed by a thermally insulating material. Solidification of the molten metal is initiated and generally effected within the mold by extracting heat from the molten metal as it passes through the mold. The solidified casting or ingot is continously or intermittently withdrawn at the discharge end of the mold. In order to assist with continuous casting withdrawal, a suitable withdrawal mechanism is provided adjacent the mold discharge end. If desired, water or some other appropriate coolant may be sprayed onto the casting as it emerges from the mold to effect additional cooling.

One of the major problems encountered in continous casting of thin sections is premature freezing of the molten metal, particularly adjacent the mold inlet area. Since the mold is the major source of heat extraction, the necessary contact between the mold and the metal feed system outlet, e.g. a feed nozzle, means an unavoidable cooling of the latter. As a result, a shell of metal may form near the mold inlet and extend back or freeze-back into the feed system outlet. This skin of metal can disrupt the mechanics of the solidification process by altering molten metal flow to the mold. In addition, local sticking of the metal shell may occur. As a consequence of these events, surface quality of the casting may be adversely affected and termination of a casting run may occur prematurely as a result of sufficient shell sticking to effect severe tearing through which molten metal flow.

When water cooled copper molds are employed for horizontal continous casting of ferrous and non-ferrous metals and alloys, the liquid metal is delivered into the mold with a refractory feed nozzle constructed of fibrous insulating material which is fitted into the entrance of the water cooled copper section. This design creates two major problems. First, the rapid heat transfer occuring in the water cooled copper mold results in uncontrolled freeze-back of metal into the refractory feed nozzle. Since the refractory nozzle is porous, the solidified metal locks or adheres to the refractory and causes a tearing of the strip as it is extracted from the mold. This problem may ultimately cause termination of the casting run either by strip tearing and liquid spill out or by choking off of the liquid metal supply due to massive freezing in the feed nozzle. A second major problem is caused by solidifying metal flashes formed at the joint between the refractory feed nozzle and the copper mold. The joint between the refractory nozzle and the mold opens due to errosion of the feed nozzle caused by intermittent freeze-back of solidifying strip and pull away or by opening of this joint as a result of differences in thermal expansion between the refractory nozzle and the metal mold. In either case, the solidified metal flashes adhere to the mold and cause tearing of an upstream section of the strip away from the downstream section and may ultimately lead to bleed out of liquid metal through the mold outlet.

To prevent adhesion of the metal to the mold wall, it is known to supply a lubricant around the inner mold surfaces. The lubricant spreads over the mold surfaces and prevents metal-to-metal contact.

Frequently, the lubricant is supplied from a source of lubricant, such as an annular channel surrounding the mold, directly to the mold interior via one or more passageways adjacent the molten metal inlet portion of the mold. U.S. Pat. Nos. 3,286,309 to Brondyke et al., 3,329,200 to Craig, 4,103,732 to Habert and 4,157,728 to Mitamura et al. illustrate this type of lubricant supply system. In some lubrication systems, the passageway or passageways lie between the mold inlet portion and a feed nozzle outlet portion. U.S. Pat. Nos. 3,040,396 to Hudson and 3,630,266 to Watts exemplify this latter type of system.

To provide better control over the rate of flow of lubricant into the mold, it has been suggested in the prior art to incorporate a porous body, such as a gasket or a wick, into the lubricant feed system. The porosity of the body incorporated in the feed system determines the rate of lubricant flow. U.S. Pat. Nos. 4,214,624 to Foye et al. and 3,451,465 to Moritz illustrate lubricant feed systems incorporating a porous body.

While these prior art lubrication systems assist in preventing adhesion of the metal shell to the mold wall, they do not significantly prevent premature metal freezing and freeze-back into the outlet of the molten metal supply or feed system. This freeze-back problem can be particularly troublesome during the casting of relatively thin members such as strip material since it represents a significant portion of the tube cross-section.

The thin metal shell formed as a result of freeze-back within the outlet portion of the feed system has relatively little strength and shell tearing occurs easily. Tearing of the shell may cause disruptions in lubricant flow and/or the normal supply of molten metal to the mold. As previously discussed, these disruptions may cause the production of surface defects in the cast product and the termination of casting.

It has been suggested in the prior art that the freeze-back problem may be avoided by applying heat adjacent the feed nozzle/mold interface. In one such system, the feed nozzle is surrounded by heating coils. Heat supplied to the metal within the feed nozzle prevents any solidification of the molten metal. U.S. Pat. No. 3,587,718 to Hopkins exemplifies this type of system.

In a similar system, a duct is attached to the inlet end of the mold. Molten metal is fed to the mold through a feed spout or nozzle extending into the duct. Heat is applied to the metal in the duct by an electrical induction coil surrounding the duct. Any metal solidified on the end of the feed spout is melted and the metal within the duct remains molten. A lubricating material is applied to the periphery of the metal at the mold entrance via pipes extending through the duct. This type of system is shown in U.S. Pat. No. 3,612,149 to Rossi.

While these systems do perform effectively, they tend to be complicated and cumbersome. Frequently, the feed duct or nozzle needs to be formed from special materials and/or needs to be preheated for relatively long periods of time prior to the initiation of a casting run. In addition, the casting run may have to be terminated if the heating system fails.

U.S. patent application Ser. No. 438,674 entitled "Casting System Having Lubricated Casting Nozzles" by R. S. Sokolowski relates to the present invention in that it discloses a feed nozzle formed from a porous material and having a system for supplying lubricant to the inner surface of the feed nozzle embedded therein. The lubricant prevents adhering of the metal shell formed within the feed nozzle to the feed nozzle surface.

U.S. Pat. No. 3,726,333 to Goodrich et al., U.S. Pat. No. 3,730,251 to Webbere et al. and an article entitled "Horizontal Continuous Casting of Nickel Base Alloy" by Harvey et al. are directed to horizontal continous casting.

Vertical casting molds as disclosed in U.S. Pat. Nos. 2,747,244, 3,085,303 and 4,074,747 are directed to casting molds formed of different materials.

The instant invention provides an apparatus and a process for effectively controlling the continuous casting operation so as to avoid disruptions in molten metal flow to the casting mold and to prevent local sticking of any molten metal shell. The apparatus includes a feed nozzle for supplying molten metal to the mold. The feed nozzle is formed of a refractory material having a substantially lower coefficient of thermal expansion than the water cooled casting mold. A transition section consisting of an intermediate thermal conductivity and low thermal expansion metal is inserted between the mold (typically water cooled copper) and the refractory feed nozzle. The transition section hinders heat flow into the mold wall and thereby reduces the solidification rate so as to prevent freeze-back into the feed nozzle.

It is a problem underlying the present invention to provide an apparatus and process for continuous horizontal casting of an ingot without local sticking of the metal shell.

It is an object of the present invention to provide an apparatus and process for continuous horizontal casting of an ingot which obviates one or more of the limitations and disadvantages of the described prior processes.

It is a further advantage of the present invention to provide an apparatus and process for continuous horizontal casting of an ingot that has particular utility in the casting of relatively thin strip.

It is a yet further advantage of the present invention to provide an apparatus and process for continuous horizontal casting of an ingot wherein freeze-back of metal into the inlet feed nozzle is prevented.

It is a still further advantage of the present invention to provide an apparatus and process for continuous horizontal casting of an ingot which substantially eliminates problems associated with freeze back and formation of weak shelled structures.

Accordingly, there has been provided an apparatus and process for continuous horizontal casting of an ingot from molten metal. The apparatus comprises a mold for effecting rapid solidification of the molten metal into the ingot. The mold is constructed of a relatively high thermal conductivity metal. A feed nozzle supplies the molten metal to the mold. The feed nozzle is constructed of a relatively low thermal conductivity refractory material. A transition component constructed of an intermediate thermal conductivity metal, is disposed between the mold and the feed nozzle for solidifying the molten metal in the transition component to prevent freeze-back in the feed nozzle.

The invention and further developments of the invention are now elucidated by means of the preferred embodiments in the drawings.

BRIEF DESCRIPTION OF THE DRAWINGS

Referring now to the drawings, FIG. 1 illustrates a continuous horizontal casting system 10 for continuously casting molten metal 12 into a solidified ingot 14. Molten metal 12 is supplied from a source such as a furnace (not shown) to a reservoir such as a tundish (not shown). The molten metal is then fed through a feed nozzle 16 into the inlet portion of direct chill, hereinafter DC casting mold 18. Casting mold 18 comprises an open ended body having a cross-sectional size and shape corresponding to the cross-sectional size and shape of the ingot 14 to be cast. Surrounding the mold is a manifold 20 containing a suitable coolant such as water. Manifold 20 communicates with a supply of coolant via any suitable means. Solidification of the molten metal is effected by extracting heat from the molten metal as it passes through the mold 18.

Ingot 14 is withdrawn from the mold 18 by a suitable withdrawal mechanism (not shown) such as a V-belt or a roller arrangement. If desired, this additional coolant may be sprayed onto the emerging ingot 14.

Disruptions in the flow of molten metal to the mold and the problem of local sticking may occur as a result of freeze-back of the metal shell into the outlet portion of the feed nozzle 16.

Figure 1:
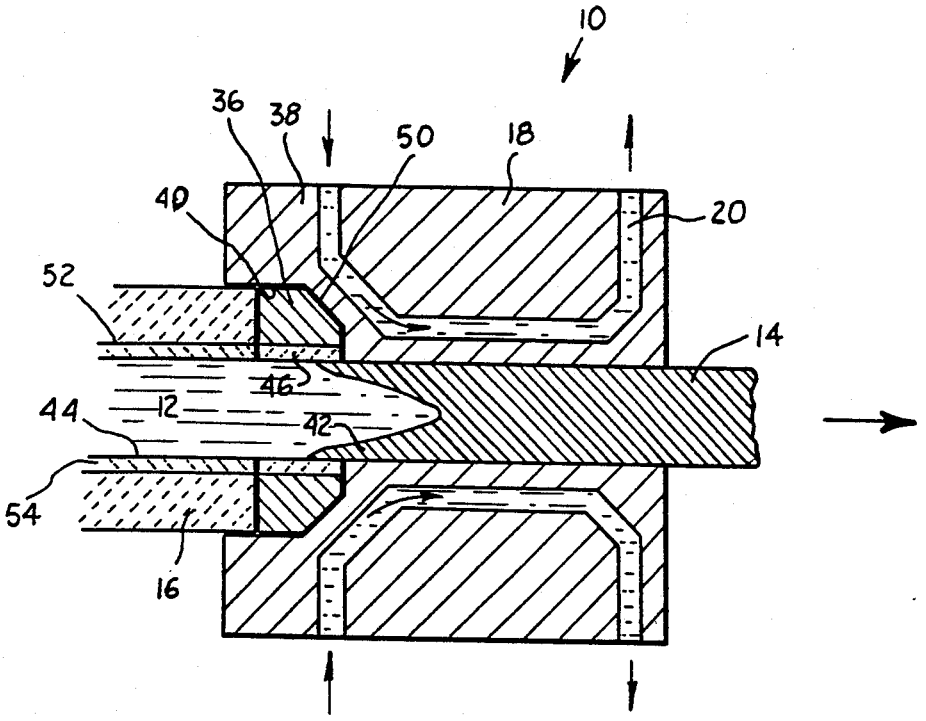
FIG. 1 is a schematic representation in cross-section of a side view of a portion of a continuous horizontal casting apparatus in accordance with the present invention.
Figure 2:
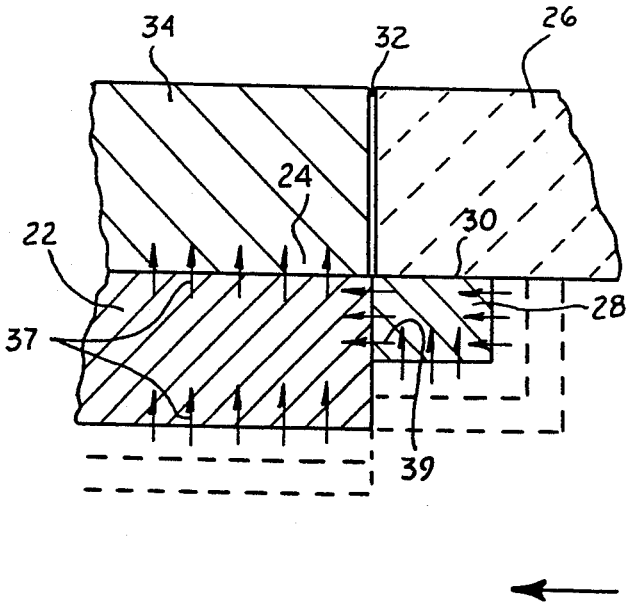
FIG. 2 is an illustration of the concept of freeze-back of a metal shell into a molten metal feed system.

This feed-back problem, in a conventional mold comprising a copper cooled mold abutted against a feed nozzle formed of a refractory, is illustrated in FIG. 2. As shown therein, metal shell 22 may grow back beyond the mold inlet portion 24 onto the feed nozzle 26. Since the heat transfer through the feed nozzle 26 is quite low, a thin, relatively weak, solid shell 28 forms and adheres to the wall 30 of the feed nozzle 26. As mentioned hereinabove, the shell which adheres to the refractory feed nozzle may rupture or tear as the solidified shell 22 is being withdrawn from the mold. The result could be a disruption in the solidification of the melt into the shell 22 and the production of surface defects in the final cast product. The freeze-back problem can be even more acute when the tear results in the bleed out of the liquid metal through the mold outlet.

A partial solution to the freeze-back of the solidified shell and its adherence to the feed nozzle is to pull the solidified ingot from the mold using a technique called intermittent withdrawal. For example, the ingot may initially be pulled from the mold at a desired velocity. Due to the problem of freeze-back, the melt may solidify into a shell and adhere to the wall of the feed nozzle. Then a tearing occurs due to the weakness of the thin, partially formed shell. To correct this problem, the withdrawal of the ingot is stopped and the tear is mended by solidification of molten metal around it. Then the withdrawal of the ingot begins again and so on through repeated cycles. The time that the ingot remains in the stationary position is limited because if the solidified shell in the feed nozzle grows too large, the thermal capacity of the melt will not be adequate to prevent the complete solidification of the ingot back into the molten metal feed system thus causing termination of the cast. This is a particular problem with the section strips where the thermal capacity of the melt in the lead system is naturally low because of the small volume of melt available in this region.

Referring again to FIG. 2, a joint 32 may be formed between the mold 34 and the refractory nozzle 26 for the reasons set out directly below. The mold is typically formed of a copper material having a relatively high coefficient of thermal expansion of about $17\times10^{-6}$ in/in/°C. By contrast, the refractory feed nozzle 26 may be formed of a refractory material such as alumina which has a coefficient of thermal expansion of about $9\times10^{-6}$ in/in/°C. The heat which is being extracted through the mold and the feed nozzle causes each of these components to expand at a different rate, ie. the feed nozzle expands at about one half the rate of the mold. The effect of the differential in the coefficients of thermal expansion of these components may result in creating a joint 32 or at least some separation between the feed nozzle and the mold. Molten metal can then flow into the joint and form a flashing which adheres to the mold wall. As the solidified ingot is pulled from the mold, tearing occurs and termination of the casting probably ensues.

The present invention is directed to the provision of a transition section 36 between the feed nozzle 16 and the mold 18. The transition component 36 is constructed of a relatively low conductivity metal which hinders heat flow therethrough and into the mold wall 38 disposed about the outer wall 40 of the transition component. The thermal conductivity is selected to be less than the Cu-Cr mold 0.75 cal/cm °C. sec but greater than the refractory feed nozzle which is $6.2\times10^{-4}$ cal/cm °C. sec but preferably between 0.001 and 0.1 cal/cm °C. sec. By reducing the heat flow through the transition element and mold wall, the solidification rate of the shell 42 is reduced and the melt is prevented from freezing back onto the inner surface 44 of the feed nozzle 16.

The length of the transition section 36 is determined through calculations of freeze-back of the solidifying shell into a feed nozzle. The heat transfer diagram used as a basis for the calculations in determining the transition element length is based on the illustration of FIG. 2. During the stationary period of a typical withdrawal cycle (or over an infintesimal time period during continuous withdrawal) the solidifying shell gross inward, toward the interior of the mold, and parallel to the mold face (indicated by the dashed lines). The heat loss through the solidified shell in the mold is indicated by arrows 37. The heat transfer or loss from the section of the shell frozen back into the feed nozzle is assumed to be in the direction of casting, indicated by arrows 39, into the section of the shell 22 at the upstream portion of the mold. This direction of heat transfer is due to the low thermal conductivity of the refractory used to construct the feed nozzle. The heat loss from the freeze-back section is then tranferred into the water cooled mold. The heat transfer responsible for the freeze back is approximated as half the shell width at the end of the dwell period multiplied by the mold width. At the beginning of the pause period, the freeze-back grows rapidly in length upstream of the interface between the mold and the feed nozzle. However, the distance across which the heat transfer must occur in order for this growth to occur also increases. This balance inherently reduces the rate of growth of the freeze-back as solidification progresses.

Using the above concepts and typical property values for the materials involved, the lengths of freeze-back for different stationary periods were calculated from mathematical equations for unit directional solidification in metal molds as described on pages 337–339 of "Transport Phenomena in Metallurgy" by Geiger et al. 1973. The results are provided below in Table I.

TABLE I

| FREEZE-BACK LENGTH (mm) | | |
|---|---|---|
| Stationary Period (seconds) | Alloy Cast | |
| | Nickel Base | Copper Base |
| 0.5 | 0.7 | 2.5 |
| 1.0 | 1.05 | 3.95 |
| 1.5 | 1.3 | 5.3 |

These figures indicate the minimum length of transition material required to prevent freeze back onto the refractory feed nozzle for specific casting systems. By providing the appropriate sized transition section between the mold the refractory feed nozzle, the freeze-back now forms on the hard transition section and does not contact the softer, more porous refractory feed nozzle. The effect is to substantially eliminate adhesion and tearing of the strip due to freeze-back.

The transition section 36 is preferably formed of a material which has a coefficient of thermal expansion of between about $10\times10^{-6}$ and about $15\times10^{-6}$ in/in/°C. This coefficient of thermal expansion is selected to be intermediate between the coefficients of thermal expansion of the refractory feed nozzle material and the water cooled mold material. Examples of suitable materials for the transition component include graphite, stainless steel, Inconel 600, alloy 42, and other materials which will not melt in the presence of the molten material being cast.

The transition section 36 is preferably provided with a refractory coating 46 on its inner surface. This coating acts to protect the underlying metal from interacting with the molten material being cast. This coating preferably is relatively dense, smooth and of a low porosity. Examples of materials suitable for this coating include refractory materials such as zirconia, alumina, silica and combinations thereof. Although it is desirable to form the coating as thin as possible to allow for heat transfer through the transition section and solidification of the melt against on section 36, it is also important to form the coating of a sufficient thickness to prevent the heat from adversely effecting the underlying transition component.

Another important aspect of the present invention relates to the mechanical fit between the transition section 36 and the mating inlet mold wall 50. Since the transition section is formed of a metal, it can be precisely machined so as to have a tight fit with the mating inlet section 50 of the mold. This fit was not possible with the feed nozzle formed of a brittle, light weight refractory material that is difficult to machine and easy to break. Since the coefficients of thermal expansion of the mold and the transition component are relatively close to being matched, and since the transition component can be machined to tightly abut against the mold, the formation of a joint between the mold and transition material is substantially eliminated. Thus the problems of forming a flashing and the ensuing tearing are also removed.

The inner wall of the transition section has substantially the same cross sectional size and shape configuration as the cross sectional size and shape of the chill mold 38. Also, the inner wall of the mold is aligned with the inner surface of the transition section to form a continuous smooth casting surface. This allows the cross sectional shape of the casting to remain unchanged as it passes from the transition section to the mold.

Feed nozzle 16 is preferably formed from a refractory material having a sufficiently low thermal conductivity so that the molten material does not have a tendency to form a shell thereon and steady state heat losses are minimized. Examples of materials which are suitable for a feed nozzle include alumina, zirconia, silica, and combinations thereof. It is also within the terms of the present invention to use any other suitable refractory material. The feed nozzle may also be coated on its inner surface 52 with a refractory material 54 such as zirconia, alumina, silica, and combinations thereof. The main consideration in selecting the coating is to form a dense, smooth coating on the inner surface of the feed nozzle without substantially increasing the thermal conductivity of the nozzle.

While a horizontal casting apparatus has been illustrated in the drawings, the instant invention is equally applicable to casting having a vertical disposition or other orientations.

As used herein, the term metal includes metal and metal alloy systems.

The patents set forth in the specification are intended to be incorporated by reference herein.

It is apparent that there has been provided in accordance with the present invention a composite mold for continuous thin strip casting which fully satisfies the objects, means and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. The process of continuous horizontal casting of an ingot from molten metal, comprising the steps of:

providing a mold having an inner wall with a first desired cross-sectional size and shape substantially the same as the cross-sectional size and shape of the ingot being cast, said mold being selected from a metal having a first desired coefficient of thermal expansion;

providing a feed nozzle for supplying molten metal to said mold, said feed nozzle being constructed of a material having a second desired coefficient of thermal expansion being less than said first desired coefficient of thermal expansion;

providing a metal or metal alloy transition section to remove heat from said molten metal and to prevent freeze-back on said feed nozzle, said transition section having an inner surface with a second desired cross-sectional size and shape being the same as said first desired cross-sectional size and shape, said transition section having a third desired coefficient of thermal expansion being between said first and second desired coefficients of thermal expansion;

disposing said transition section between and in contact with both said feed nozzle and said mold;

aligning said inner wall with said inner surface to form a smooth casting surface;

supplying said molten metal to said feed nozzle;

rapidly solidifying the molten metal into said ingot within said mold; and initiating solidification of said molten metal within said transition section so that a solidifying shell formed of the molten metal can move smoothly from the inner surface onto the aligned inner wall of said mold.

2. The process of claim 1 including the step of selecting the third desired coefficient of thermal expansion to be close to the first desired coefficient of thermal expansion to prevent separation of the inner mold wall from the inner surface of the transition section whereby a flashing does not form on the solidified shell during the casting of the molten metal.

3. The process of claim 2 including the step of selecting said third desired coefficient of thermal expansion between about $10\times10^{-6}$ in./in./°C.

4. The process of claim 3 including the step of providing a refractory coating on the inner surface of said transition section in contact with said molten material.

* * * * *